US006055496A

United States Patent [19]

Heidari et al.

[11] Patent Number: 6,055,496

[45] Date of Patent: Apr. 25, 2000

[54] VECTOR QUANTIZATION IN CELP SPEECH CODER

[75] Inventors: Alireza Ryan Heidari, Encinitias; Fenghua Liu, San Diego, both of Calif.

[73] Assignee: Nokia Mobile Phones, Ltd., Espoo, Finland

[21] Appl. No.: 09/032,205

[22] Filed: Feb. 27, 1998

Related U.S. Application Data

[60] Provisional application No. 60/041,065, Mar. 19, 1997.

[51] Int. Cl.[7] ..... G10L 9/14

[52] U.S. Cl. ..... 704/222; 704/230; 704/219

[58] Field of Search ..... 704/222, 230, 704/219, 223

[56] References Cited

U.S. PATENT DOCUMENTS 5,371,853 12/1994 Kao et al. ..... 704/222
5,710,863 1/1998 Chen ..... 704/230
5,774,839 6/1998 Shlomot ..... 704/222
5,903,866 5/1999 Shoiam ..... 704/265

*Primary Examiner*—David R. Hudspeth
*Assistant Examiner*—Daniel Abebe
*Attorney, Agent, or Firm*—Perman & Green, LLP

[57] ABSTRACT

A process for generation of codevectors in the production of synthetic speech in a communication system employing code-excited linear prediction (CELP) is implemented by dividing frames of sampled speech into sub-frames for which are generated codevectors suitable for excitation of synthesizer filters in the low-bit mode of signal transmission. Vector quantization (VQ) is employed with an algebraic representation of the CELP. A reduction of a sub-frame of 6.7 milliseconds to a vector representation of only 8 pulses results in an insufficiency of candidate codevectors, which insufficiency is overcome by a circular shifting of the codevectors at a cyclical rate equal to the pitch of the original voice signal.

14 Claims, 5 Drawing Sheets

VECTOR QUANTIZATION IN CELP SPEECH CODER

This application claims the benefit of U.S. Provisional Ser. No. 60/041,065 filed Mar. 19, 1997.

BACKGROUND OF THE INVENTION

This invention relates to a method of characterizing the excitation vector in a processor of speech operative in accordance with code-excited linear prediction (CELP) and, more particularly, to a quantization of a vector representation of speech parameters by employing perceptually important sub-vectors, to be encoded, while other sub-vectors are set to zero. The invention may be referred to as an algebraic vector quantized (VQ) type of CELP speech coder.

CELP speech coding is employed in communication of speech in various types of communication systems, and is particularly useful in cellular or radio telephone systems for compression of voice signals to attain a more efficient use of communication channel space.

The general concept of CELP processing is taught in the following references:

(1) M. S. Schroeder and B. S. Atal, "CODE-EXCITED LINEAR PREDICTION" (CELP); HIGH-QUALITY SPEECH AT VERY LOW BIT RATES; PROCEEDINGS ICASSP (IEEE International Conference on Acoustics, Speech, and Signal Processing), 1985

(2) J. P. Adoul et al, "FAST CELP CODING BASED ON THE ALGEBRAIC CODE", ICASSP, 1987

(3) D. Lin, "SPEECH CODING USING EFFICIENT PSEUDO-STOCHASTIC BLOCK CODES; ICASSP, 1987

(4) ENHANCED VARIABLE RATE CODEC, TR 45.5, PN 3292, 1996

(5) M. Satoshi et al, "A PITCH SYNCHRONOUS INNOVATION CELP (PSI-CELP) CODER FOR 2–4 KBIT/S ", IEEE, 1994

(6) C. G. Gerlach et al, "CELP SPEECH CODING WITH ALMOST NO CODEBOOK SEARCH", IEEE, 1994

(7) R. Salami et al, "8 KBIT/S ACELP CODING OF SPEECH WITH 10 MS SPEECH-FRAME: A CANDIDATE FOR CCITT STANDARDIZATION, IEEE, 1994

Due to the ever increasing use of cellular telephony, there is an increasing need to reduce the amount of communication channel capacity required for transmission of sounds, particularly the transmission of voice signals. There is also a need for high fidelity in the transmission of speech. Presently available equipment does not meet optimally the needs for both high efficiency and high fidelity in the transmission of voice signals.

SUMMARY OF THE INVENTION

The invention addresses the needs for both high efficiency and high fidelity in the transmission of voice signals by providing the advantage of better speech quality than has previously existed with CELP digital processors, while providing for efficient use of channel capacity. The invention employs circuitry for generating an excitation vector for exciting a linear prediction (LP) filter in accordance with the principles of algebraic CELP. The circuitry, which may be constructed as a suitably programmed computer, comprises both an adaptive codebook and a fixed codebook wherein the adaptive codebook serves to store previously employed codevectors and the fixed codebook serves to generate a sequence of numerous possible codevectors. A vocoder, operating in accordance with the invention, comprises the foregoing circuitry and, furthermore, provides for a circular shift of codevectors outputted by the fixed codebook to obtain many more codevectors in the generation of codewords for application to the LP synthesizing filter. Two additional filters are employed, one for removing removing periodic components speech quality. This is an improvement over current EVRC operating at maximum half rate wherein three pulses are used to represent the excitation, this being insufficient to provide the desired high quality speech. The invention may also employ a transform coding approach to encode the speech. The invention is useful in telephony including CDMA phone and potentially also in CDG/TIa and TR45 half rate standardization.

BRIEF DESCRIPTION OF THE DRAWING

The aforementioned aspects and other features of the invention are explained in the following description, taken in connection with the accompanying drawing figures wherein.

Identically labeled elements appearing in different ones of the figures refer to the same element but may not be referenced in the description for all figures.

DETAILED DESCRIPTION

The present invention provides for the development of a new vector quantization technique which improves the excitation vector in the code-excited linear prediction, CELP, speech coding, particularly for the case of the half rate enhanced variable rate coder, EVRC The invention is can be used in a digital cellular system to improve overall system capacity.

Figure 1:
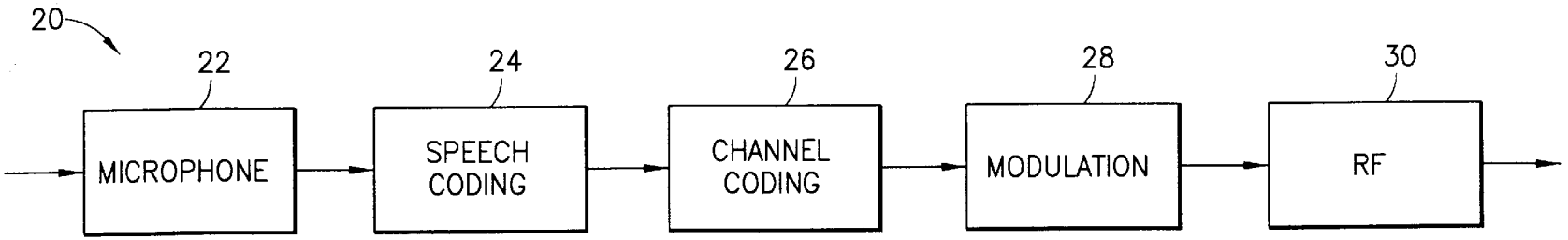
FIG. 1 PRIOR ART
FIG. 1 shows a diagrammatically components of a mobile telephone of the prior art.

In FIG. 1, a mobile telephone 20 of a digital cellular telephone system comprises a microphone 22, a speech coding unit 24, a channel coding unit 26, a modulator 28 and an RF (radio frequency) unit 30. Input speech, or voice, is converted by the microphone to an electrical signal which is applied by the microphone 22 to the speech coding unit 24. The speech coding unit 24 digitizes the analog speech signal with sampling by an analog to digital (A/D) converter, and provides speech compression by reduction of redundancy. The speech compression enables transmission of the speech at a reduced bit rate which is lower than that which is required in the absence of speech compression. The speech coding unit 24 employs various features of the invention to accomplish transmission of speech or voice signals at reduced bit rates, as will be explained hereinafter. The compressed speech is applied to the channel coding unit 26 which provides error protection, and places the speech in appropriate form, such as CDMA (code division multiple access) for transmission over the communication links of the cellular telephony system. The signal outputted by the channel coding unit 26 is modulated onto a carrier by the modulator 28 and applied to the RF unit 30 for transmission to a base station of the cellular telephony system.

Figure 2:
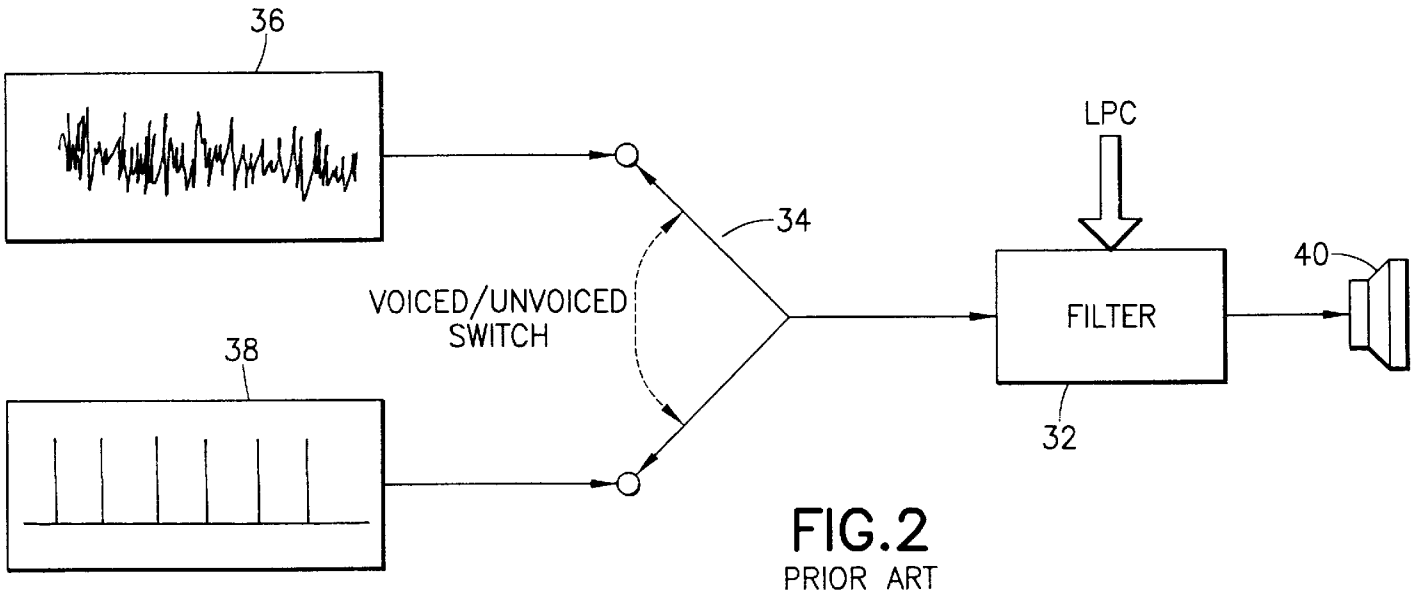
FIG. 2 PRIOR ART
FIG. 2 shows switching of voiced and unvoiced signals to a voice synthesizer filter in accordance with the prior art.

FIG. 2 demonstrates a portion of the operation of the speech coding unit 24, and serves as a model of speech generation. In FIG. 2, a linear prediction (LP) filter 32, operative in response to a set of linear prediction coefficients (LPC) connects via a switch 34 to either an unvoiced signal at 36 or a voiced signal at 38 to be inputted via the switch 34 to the filter 32. The filter 32 operates on the inputted signal to output a signal to output circuitry 40. Low bit-rate coding is critical to accommodate more users on a bandwidth limited channel, such as is employed in cellular communications. This model allows transmission of speech and data over the same channel. In the low bit-rate speech coding, the system of the speech coding unit 24 extracts a set of parameters to describe the process of the speech generation, and transmits these parameters instead of the speech waveform.

In this model, the excitation signal is modeled as either an impulse train for voiced speech at 38 or random noise for unvoiced speech at 36. The filter 32 is a time-variable filter with transfer function H(z) wherein z is the variable in the Z transform. The filter 32 is used to represent the spectral contribution of the glottal shape flow and the vocal tract. The task of the speech coding is to extract the parameter of the digital filter and the excitation and uses as few as possible bits to represent them.

The process of removal of redundancy from speech involves sophisticated mathematics. This can be accomplished by linear prediction. Linear prediction is used in the speech compression. By the linear prediction, the sample values of speech can be estimated from a linear combination of the past speech samples. The LP coefficients can be determined by minimizing the mean squared error (MSE) between the original speech samples and the linearly predicted samples. The variance of the prediction error is significantly smaller than the variance of the original signal and, hence, few bits can be used for a given error criterion. At low bit rate, the most successful linear predictive based speech coding algorithm operations in practical conditions are those which use analysis-by-synthesis (AbS) techniques.

In the speech coding system, there are two kinds of parameters which are to be encoded and transmitted, namely, (1) the model parameter constituted by the LPC, and (2) the excitation parameter. The encoding of the LPC parameter is well known. In order to avoid direct quantization of the LPC and possible instability in the inverse filter, the LPC are transformed into an equivalent set of parameters, such as reflection coefficients or linear spectrum pairs. Approximately 20–24 bits can be used to encode the LPC parameter. There remains the task of encoding the excitation signal.

In application of the model of the speech generation to low bit-rate speech coding, the optimal set of parameters for reproducing each segment of the original speech signal is found at the encoder. The optimal parameters are transmitted from the encoder to a decoder at a receiving station. The decoder employs the identical speech production model and the identical set of parameters to synthesize the speech waveform. Coding of the parameters, rather than a coding of the entire speech waveform results in a significant compression of data.

Figure 3:
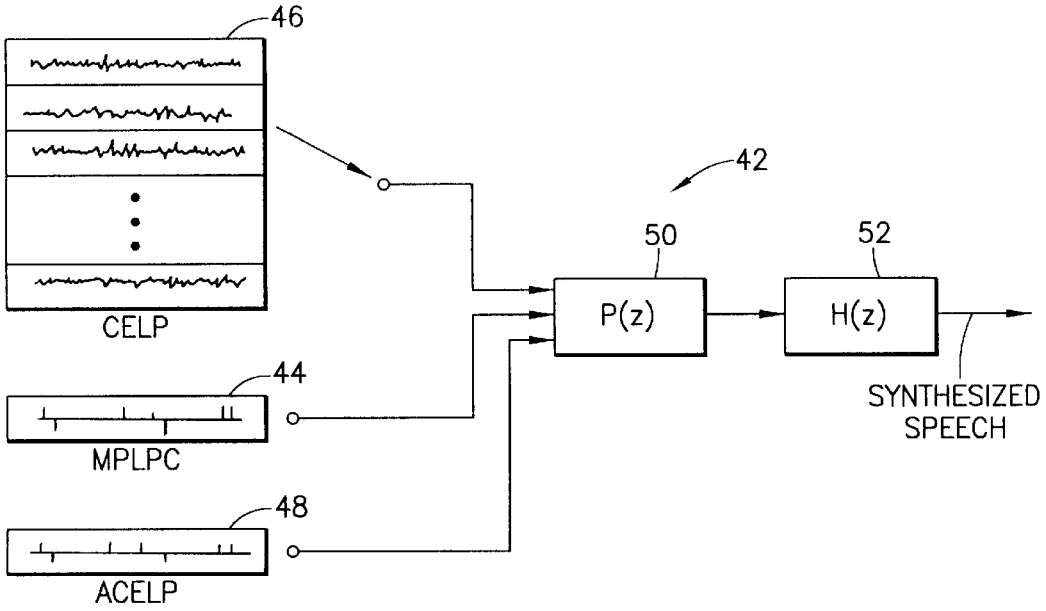
FIG.3 PRIOR ART
FIG. 3 shows different forms of code excitation in accordance with the prior art.

With reference to speech coding systems of the prior art, FIG. 3 shows a diagrammatic representation of speech coding system 42 employing employing any one of a plurality of different excitation structures or the prior art, including excitation by multi-pulse linear prediction coding (MPLPC) at block 44, code excited linear prediction (CELP) at block 46, and algebraic CELP (ACELP) at block 48. Also included within the system 42 are a pitch filter 50 having a transfer function P(z), and a speech synthesizing filter 52 having a transfer funciton H(z).

In the operation of the system 42 with CELP excitation, the excitation vector is chosen from a set of previously stored stochastic sequences. During codebook search, all possible codevectors from a codebook are passed through the pitch filter 50 and the synthesizer filter 52. Upon application of the codevectors to the system 42, there results a set of output signals characterized by differing values of mean square error. The codevector that produces the minimum value of means squared error is chosen as the desired excitation. Identical codebooks are employed at the synthesizer filter 52 and a corresponding filter (not shown) at a receiving telephone, According, it is necessary to transmit only an index corresponding to the selected codevector.

In the operation of the system 42 with MPLPC excitation, no voiced/unvoiced classification is performed on the speech. The excitation is specified by a small set of pulses with differing amplitudes and differing positions, within a time-domain representation, of the pulses. Since there is no constraint on the pulse position and the pulse amplitude, a coding algorithm requires a relatively large number of bits to encode the pulse position and the pulse amplitude.

In the operation of the system 42 with ACELP excitation, use is made of an interleaved single-pulse permutation designed to divided the pulse positions into several tracks. All pulses have a common fixed amplitude, and only the signs (plus or minus) of the pulses are transmitted. By employing fast deep-tree search and pitch shaping, ACELP has succeeded in providing high quality speech at low bit rate. The speech coding standards used in TDMA, CDMA and GSM are base on the ACELP.

In the practice of the present invention, it is noted that for transmission at low bit rate, it is important to quantize perceptually important components. ACELP uses an efficient way to encode the pulse positions, and encodes only the sign of the pulses since all of the pulses have a common amplitude. In order to maintain a good quality of speech in the transmission process, four to eight pulses are used, depending on the size of a subframe. For transmission at low bit rate, there is an insufficient number of pulses to encode the excitation pulses. Therefore, the number of the excitation pulses would have to be reduced, or the pulses positions must be constrained to preselected positions, such a situation resulting in a degradation of the quality of the synthesized speech. For example, in the full rate enhanced variable rate coder (EVRC), 35 bits are used to encode the 8 excitation pulses; in the half rate coding, only 10 bits are used to encode 3 excitation pulses. An insufficient number of excitation pulses results in degradation of quality in transmission in the half rate EVRC.

In accordance with the invention, there is an improvement in the performance of the low-bit rate coder by increasing the coding efficiency. This is accomplished by vector quantization (VQ) in the excitation. There is a generalization of the multi-pulse excitation concept to include multiple subvectors. This is accomplished by grouping several samples into a sub-vector. Therefore, there are several sub-vectors in a subframe. Only the perceptually important sub-vectors are encoded, and the other sub-vectors are set to zero. The sub-vectors are positioned with positions of the sub-vectors being encoded in a manner similar to that of the algebraic codebook. Thus, the speech coding method of the invention may be called algebraic VQ CELP. In a typical situation, speech is transmitted at a rate of 8,000 samples per second. Thus, in an interval of 20 milliseconds (ms), there are 8000×0.02=160 samples. A sequence of 160 multibit digitized samples of the input voice signal (obtained by passing the voice signal through analog-to-digital (A/D) conversion) occurs in an interval of time of 20 ms. The sequence of 160 samples, may be regarded as a frame of data. The frame of data is divided into three sub-frames having essentially equal intervals of time, namely, an interval of 20/3 ms equal approximately to 6.7 ms. Herein, there would be 160/3 samples leaving unequal numbers of samples in the sub-frames, which would be 53, 53 and 54 samples in respective ones of the sub-frames.

The synthesized speech is constructed by a procedure referred to as analysis by synthesis. Patterns of speech are described by 1024 vectors which are generated by a fixed code book. In this vector representation, there are ten bits for each sub-frames. By use of the vectors as excitation signals for a speech synthesizing filter, there are generated possible replicas of an input voice history by use of the code book. A candidate replica of the synthesized speech is compared with a previously stored record of the voice history. An error is obtained and a further trails are run with different values of signal gain and with different vectors of the code book. A minimum value of the error, in a mean-square sense, signifies the right vector, and this vector is to be transmitted to a distant site along with the appropriate value of the gain, and with the set of linear prediction (LP) coefficients employed in the speech synthesizing filter. At the distant site, receipt of the voice message is accomplished by passing the received vector in conjunction with an appropriate value of gain through an identically functioning speech-synthesizing filter which is employed with the same set of LP coefficients to regenerate the original voice. With respect to each of the aforementioned 54 samples in the sub-frame, there are 6 sub-vectors each of which have 9 samples for a total 9×6=54. If represented by only three subvectors, there are 3×9=27 samples. Three bits are employed to identify the selected three sub-vectors from the set of six sub-vectors, wherein each of the bits may have one of two possible states to identify one of two sub-vectors. The three sub-vectors (each having the 9 samples) are selected out of the six sub-vectors providing the best match, and then by concatenation, form a vector of 27 dimensions. There is obtained a reduction in bandwidth required for transmission of the voice, by a ratio of 16:1, from a rate of 64 kilobits per second to 4 kilobits per second.

For the sub-frame of 6.7 ms, 10 bits are employed for transmission of the voice data. Of this 10 bits, 7 bits are employed for transmission of the code-book index representing a choice of 127 vectors serving as descriptors of human voice, and 3 bits are available for the 3 sub-vectors. Pitch data is provided by the speech processor. A vector is rotated, as by means of a recirculating shift register, at the fundamental frequency of the pitch, so that each component or dimension of the vector can be evaluated to give the best match. The unvoiced signal may be represented by pseudo-random noise.

Figure 4:
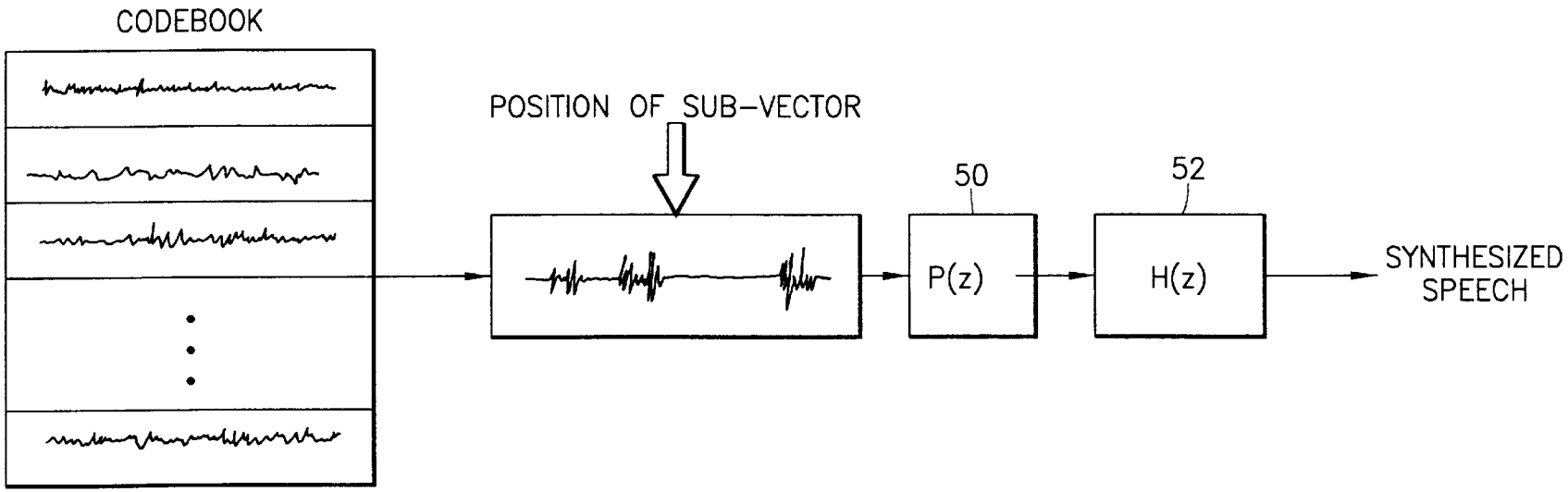
FIG. 4 shows the positioning of a sub-vector from a codebook in accordance with the invention.

In the algebraic VQ CELP, portrayed in simplified fashion in FIG. 4, the residual generated by passing the target vector to the linear predictor filter 52 is first filtered by the pitch filter 50 to eliminate long term correlation in each sub-frame, as will be described in further detail hereinafter with reference to FIG. 6. Five samples are grouped together to form a sub-vector. In order to maintain the pitch periodicity of the fixed excitation, partition of the sub-vectors is based on the pitch period. The total number of the sub-vectors is equal to the integer part of the value of the pitch divided by 5 and bounded by 3 and 11. The sub-vectors are arranged in an interleaved order as follows:

| Bit | Sub-vectors | | | |
|---|---|---|---|---|
| 0 | 0 | 3 | 6 | 9 |
| 1 | 1 | 4 | 7 | 10 |
| 2 | 2 | 5 | 8 | (11) |

Six bits are used to present the positions of the three sub-vectors.

Alternatively, the total number of the sub-vectors is equal to the integer part of the value of the pitch divided by 9 and bounded by 3 and 6. The sub-vectors are arranged in an interleaved order as follows:

| Bit | Sub-vectors | |
|---|---|---|
| 0 | 0 | 3 |
| 1 | 1 | 4 |
| 2 | 2 | 5 |

Three bits are used to present the sub-vectors to be quantized.

In both embodiments of the invention, the foregoing arrangement of the sub-vectors may be regarded as a direct extension of the multi-pulses coding technique where only one sample is selected to be quantized. The invention employs quantization of a vector instead of a scalar.

Typically, speech is classified as voiced or unvoiced, each having its own waveform. The different speech waveforms may be encoded by different modes. It is noted that the adaptive codebook, to be described with reference to FIG. 6, cannot remove all redundancy in speech. The pitch period excitation can provide improvement in the synthesized speech. The selection of the three sub-vectors is based on the pitch period for the voiced speech. In the unvoiced case, the selection of the three sub-vectors is always based on the subframe size. In the strong voiced case, two pulses ACELP is used instead of the VQ. The switch between the mode is made based on the gain of the adaptive codebook; therefore, no extra bit is needed to indicate the mode selection.

In the algebraic VQ CELP, the first step is to select three perceptually important sub-vectors. There are two ways to select the sub-vector. One way employs the closed-loop approach wherein every possible combination of the three sub-vectors are passed through the synthesized filter. The combination of the three sub-vectors resulting n the minimum mean squared error is selected. In this way, the selection of the sub-vector and the codevector are optimized jointly.

Figure 5:
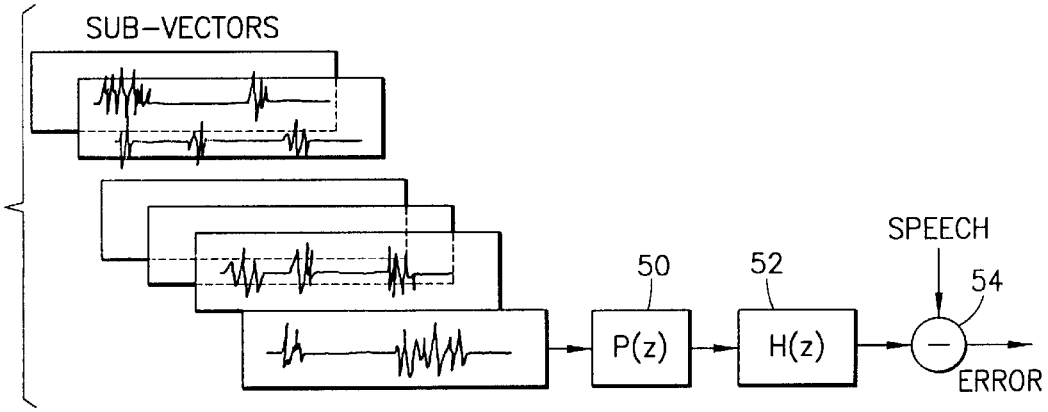
FIG. 5 demonstrates selection of sub-vectors.

In accordance with the invention, the open-loop approach may be employed to reduce complexity associated with the joint optimization of the sub-vector and the codevector. In the open loop approach, the selection of the sub-vector and the codebook search are sequentially performed. In this approach, the selection of the sub-vector is base on the residual signal, described hereinafter with reference to FIG. 6. Full search is used to select the three sub-vectors. In each selection process, as outlined in FIG. 5, the three selected sub-vectors are kept the same according to the interleaved order. The other unselected sub-vectors are set to zero. The resultant vector is passed through the pitch-shaping filter 50 and the synthesizer filter 52 to generate a synthesized signal which is to be compared with a target vector. The three subvectors resulting in the minimum distortion are selected to be quantized. In FIG. 5, the synthesized signal outputted by the filter 52 is compared with the original speech by subtraction of the two signals at a subtracter 54 to output the error.

The selection of the important sub-vectors enables a more efficient quantization of the excitation with use of less memory to store the fixed codebook. The three selected sub-vectors are concatenated to form a new 15-dimension vector which is to be quantized based on the closed-loop analysis.

By way of comparison with the prior art, it is noted that in the original CELP synthesis process, the codebook is searched directly from the codebook. As mentioned above, when the speech codec rate changes from the full-rate to the half rate in EVRC, the bits used to present the excitation drop from 35 to 10. A a result, there are not enough excitation patterns to match the original excitation waveform. The invention compensates for this deficiency by providing for a circular shift of the fixed codebook based on the signal generated by the adaptive codebook. Preferably, the selection of the shift should be done with the target vector. Such an operation requires an additional bit to transmit the circular shift information.

In accordance with a feature of the invention, transmission of the circular shift information can be made unnecessary by use of the adaptive codebook as a reference signal. The circular shift operation is performed only for the voiced speech signal. The shift decision is determined based on the gain of the adaptive codebook gain. For the case wherein the adaptive codebook gain is above a threshold, the adaptive codebook tracks the input speech well, and the circular shift operation is performed. If the adaptive codebook gain is below the threshold, the circular shift operation is not carried out. Open-loop operation is employed to determine the shift of the fixed codebook for reduction in complexity of operation, and to maximize the cross-correlation of the target signal and the excitation signal, namely, $$\mathrm{Max}(|c^T H^T H x_a|)$$

where $x_a$ is outputted by the adaptive codebook, c is the codevector, H is a Toeplitz matrix (to be described hereinafter), and T represents the transpose of a matrix. Since the decision of the shift is based on the adaptive codebook, there is no need to transmit the shift information.

Use of the pitch filter improves the perceptual quality of the synthesized speech. Advantageously, the pitch shaping of the excitation can be incorporated into the codebook search, this being accomplished by modification of the impulse response of a pitch-shaping filter (to be described with reference to FIG. 6).

In the use of the algebraic VQ, it is necessary to preserve alignment between vector endpoints and the main pitch pulse. In the case wherein relatively high magnitude samples of the main pitch pulse fall on the boundary between two vectors, both vectors are to be selected and represented well in the synchronized signal. Also, a variable position of the main pitch pulse with respect to the vector endpoints is to be controlled by bringing the maim pulse to the middle of the vectors to insure efficient codebook training.

The reference for endpoint adaptation is the adaptive codebook is available at the encoder and the decoder. Using this reference for adaptation avoids the need for transmitting side information regarding endpoint position. Another advantage of endpoint adaptation is to shift the target vector before searching the fixed codebook to reduce complexity of search. This is understood by denoting by na the largest sample in the adaptive codebook. Then, the first vector stating point, $n_1$, is given by the equation $n_1=n_a-2$. If $n_1$ is negative, the sequence will be shifted to the right, otherwise, to the left. In this way, implemented by an algorithm, the main pulse will be located in the desired position. The foregoing shift operation is performed, preferably, only when the adaptive codebook gain is greater than a predetermined threshold.

Figure 6:
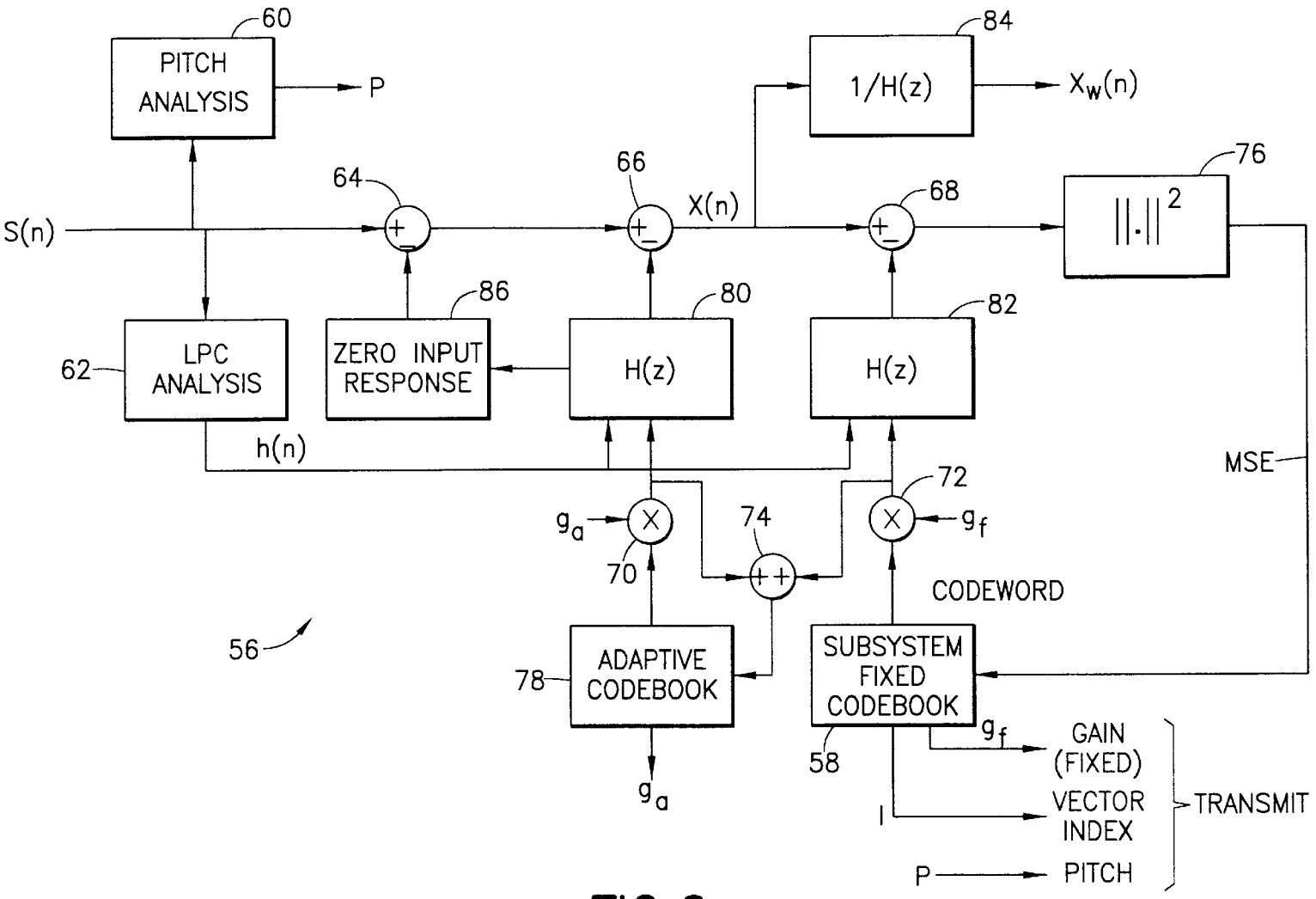
FIG. 6 shows diagrammatically components of a CELP coder adapted for the invention by inclusion of a subsystem of fixed codebook for searching the fixed codebook.

FIG. 6 shows details in the construction of a CELP coder 56 employing a fixed codebook subsystem 58 of the invention, the fixed codebook subsystem 58 to be described with reference to FIG. 7. In FIG. 6, the coder 56 applies the input signal S(n) to block 60 wherein a long term analysis is performed to calculate pitch P of the input signal, to block 62 wherein an analysis is performed to determine a set of linear prediction coefficients (LPC), and to a subtracter 64. The coder 56 further comprises two subtracters 66 and 68, two multipliers 70 and 72, a summer 74, a calculator 76 of mean square error (MSE), an adaptive codebook 78, two synthesizer filters 80 and 82, and an inverse synthesizer filter 84.

In an overview of the operation of the coder 56, a codeword outputted by the adaptive codebook 78 is multiplied at multiplier 70 by a gain $g_a$ and applied to the filter 80 which synthesizes a corresponding voice signal to be applied to the subtracter 66. The zero signal input response of the filter 80 is obtained at block 86 to be applied to the subtracter 64. A codeword outputted by the fixed codebook subsystem 58 is multiplied at multiplier 72 by a gain $g_f$ and applied to the filter 82 which synthesizes a corresponding voice signal to be applied to the subtracter 68. By means of the subtracters 64, 66 and 68, the voice signals outputted by block 86, by filter 80 and by filter 82 are subtracted from the input voice signal S(n) to produce an error signal at the output of the subtracter 68. The error signal is applied to the calculator 76 to determine the MSE which is then applied to the fixed codebook subsystem 58. The output of the subtracter 66 is a residual target vector x(n), and is applied to the filter 84 to produce the perceptual target vector $x_w(n)$. The signals to be transmitted by the coder 56 are outputted by the fixed codebook subsystem 58, these signals being the fixed gain $g_f$, the index I of the fixed codebook vector, and the pitch P.

In further detail, the operation of the coder 56 is as follows. The filters 80 and 82 have the same transfer function H(z), and the filter 84 has the inverse transfer function 1/H(z). At block 62, based on the LPC, the impulse response h(n) of the synthesizer filter 80 is also calculated, and is applied to the filters 80 and 82. The adaptive codebook 78 provides the gain $g_a$ and the fixed codebook subsystem 58 provides the gain $g_f$. The signals outputted by the multipliers 70 and 72 are summed together at the summer 74 and applied via the summer 74, as previous excitation signal $x_a(n)$, to the adaptive codebook 78. In the speech analysis stage, the zero input response of the synthesizer filter 80 is first calculated at block 86, and is subtracted from the input speech at the subtracter 64. The adaptive codebook 78 contains the previous excitation $x_a(n)$. The gains $g_a$ and $g_f$ are adjusted to output reconstructed speech signals from the filters 80 and 82 which match the input speech waveform. The fixed codebook subsystem 58 outputs the index I of the codeword and the gain $g_f$ which minimizes the MSE.

Figure 7:
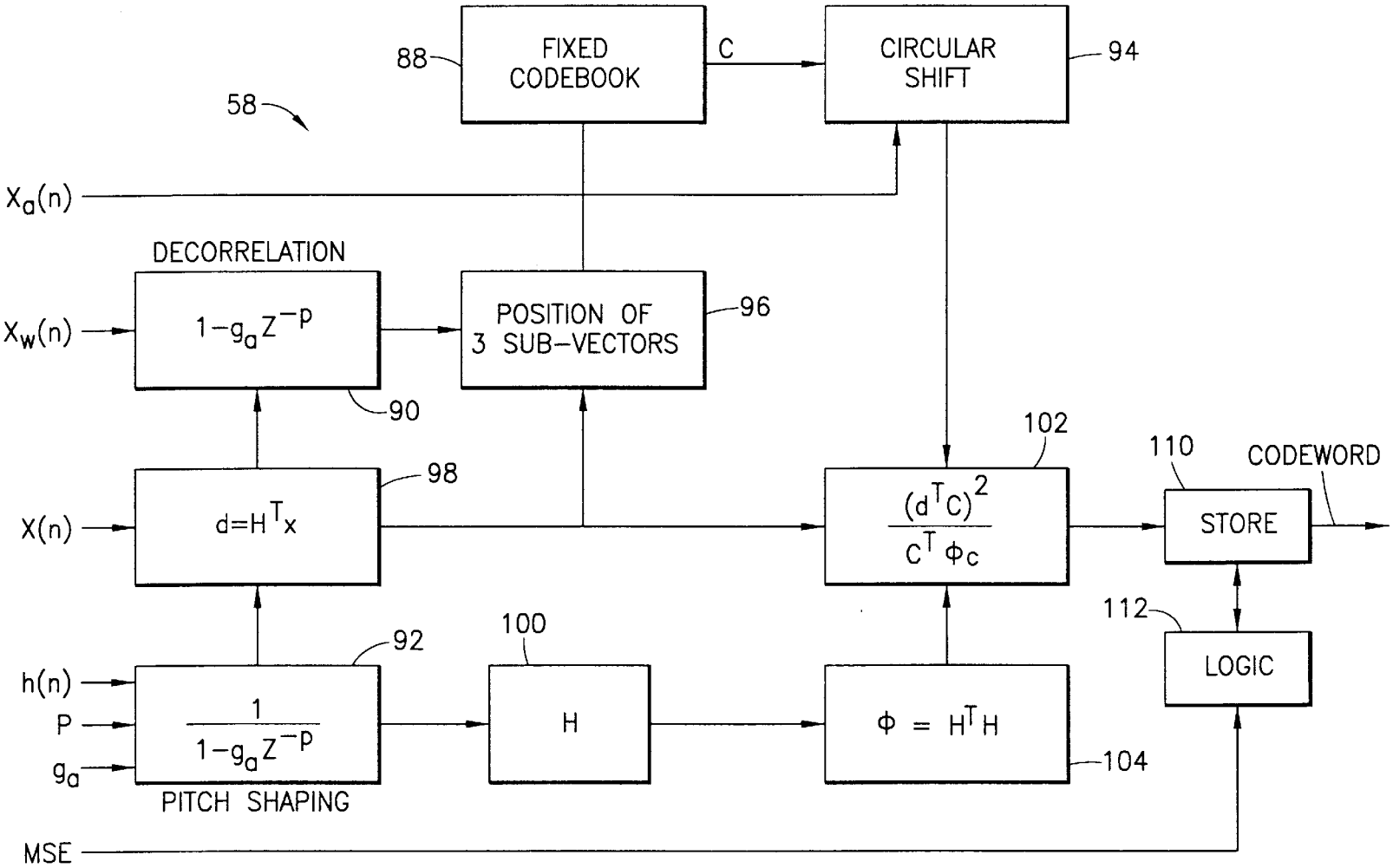
FIG. 7 shows diagrammatically components of the fixed codebook subsystem of FIG. 6.

FIG. 7. provides a description of the inventive features concerning the searching of the fixed codebook 88 by the codebook subsystem 58. The codebook subsystem 58 further comprises a decorrelation filter 90, a pitch-shaping filter 92, a circular shifting block 94, a vector positioning block 96, and four mathematical processing blocks 98, 100, 102 and 104 for implementations of matrix arithmetic such as multiplication, division and transposition. These components provide for the generation of codevectors in accordance with the procedure described hereinabove.

The operation of the subsystem 58 for accomplishing a fixed-codebook search is as follows. The inputs of the fixed codebook search are the target vector x(n) and its corresponding perceptual target vector $x_w(n)$, the impulse response h(n) of the filter 80, the adaptive codebook gain $g_a$, and the pitch P which is determined durina a search of the adaptive codebook 78 (FIG. 6). The signal $x_a(n)$, input to the adaptive codebook 78, is first passed through a long term decorrelation at the filter 90 having a transfer function $[1-g_a z^{-P}]$. The decorrelation filter 90 is employed to supplement the capacity of the adaptive codebook 78 in removal of long term correlation terms in voice signals at the low bit rate. The impulse response h(n) is passed through the pitch-shaping filter 92 to enhance the periodic property of the synthesizer filters 80 and 82. The pitch-shaping filter 92 has a transfer function $P(z)=[1-g_a z^{-P}]^{-1}$. Block 100 employs the pitch-shaped impulse response h(n) to form an impulse response matrix H, a Toeplitz matrix given by $$H=\begin{bmatrix} h[0] & 0 & . & . & . & . & 0 \\ h[1] & h[0] & 0 & & & & 0 \\ h[2] & h[1] & h[0] & 0 & & & . \\ h[3] & h[2] & h[1] & h[0] & 0 & & . \\ . & . & . & . & . & . & . \\ . & . & . & . & . & . & . \\ h[n-1] & h[n-2] & h[n-3] & . & . & h[0] & \end{bmatrix}$$

From the impulse response matrix, the auto-correlation matrix $\Phi=H^T H$ is computed at block 104, and is then sent to block 102 for determination of the best codevector.

Block 98 computes the back-filtered signal $d=H^T X$ which is sent to blocks 96 and 102. The output of the filter 90 is also sent to block 96. Block 90 operates to determine the positions of the three sub-vectors wherein the criterion of selection is to maximize the correlation between the back-filtered signal d and the output of the filter 90. The positions of the three sub-vectors are sent to the fixed codebook 88. Based on the positions of the sub-vectors, the excitation vector can be constructed for every codevector. The resultant excitation vector is sent to block 94 where every codevector is circular shifted, and the correlation between the circular-shifted excitation vector and $x_a(n)$ is calculated. The shift generating the maximum correlation is selected as the final shift value. The codevector from block 23, along with d from block 98 and Φ from block 104 are sent to block 24 wherein the the optimal codevector is selected to maximize $(c^T d)^2/c^T \Phi c$. The outputs of the fixed codebook search are the index of the codevector and the gain of the fixed codebook.

The Generalized Lloyd algorithm (GLA) is used to design the VQ codebook. The MSE of the j-th codevector can be expressed as $$\varepsilon=\sum_j \|t_j-g_j H_j P_j S_j c_j\|^2$$

wherein $t_j$ denotes a target vector, $H_j$ denotes the impulse respmnse matrix, $P_j$ denotes the mapping of the selected sub-vector to the excitation and $S_j$ denotes the shift operation on the fixed codevector $c_j$. The matrix S is given by $$s=\begin{bmatrix} 0 & 1 & 0 & 0 & \dots & 0 \\ 0 & 0 & 1 & 0 & \dots & 0 \\ 0 & 0 & 0 & 1 & \dots & 0 \\ . & . & . & . & \dots & . \\ . & . & . & . & \dots & 0 \\ 0 & 0 & 0 & 0 & \dots & 0 \\ 1 & 0 & 0 & 0 & 0 & 0 \end{bmatrix}$$

The optimal codevector that minimizes the MSE is given by $$c_j=\left(\sum_j (g_j^2 S_j^T P^T H_j^T H_j P_j S_j)\right)^{-1}\sum_j (g_j S_j^T P_j^T H_j^T t_j)$$

Codevectors outputted by block 102 are stored at 110 and observed by logic unit 112. The logic unit 112 is operative in response to the MSE to select for storage a codeword which minimizes the MSE while discarding other codewords. Thereby, at the conclusion of a search of the fixed codebook, the store 110 contains the codeword which minimizes the MSE.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A method of characterizing the excitation vector in a processor of speech operating in accordance with code-excited linear prediction (CELP), the method comprising the steps of:

establishing a set of sub-vectors, each of which comprises several samples of speech;

identifying sub-vectors carrying speech information important for perception of speech by a person listening to the speech;

encoding perceptually important sub-vectors;

setting other ones of the sub-vectors to zero, and constructing the excitation vector of the set of sub-vectors wherein the excitation vector is quantized by the sub-vectors which have been set to zero; and wherein the total number of the sub-vectors is equal to the integer part of pitch divided by 9 and bounded by 3 and 6 wherein 9 samples of speech are grouped together to form one of said sub-vectors.

2. A method according to claim 1 wherein there are three of said perceptually important sub-vectors.

3. A method according to claim 1 further comprising a step of determining the presence of voiced and unvoiced signals inputted to said speech processor, and applying said identification and said encoding steps only to said voiced signals.

4. A method according to claim 3, wherein, in the presence of a strong voice, there is a step of representing the voice by two pulse algebraic CELP.

5. A method according to claim 3 wherein in the presence of an unvoiced signal, there is a step of representing the unvoiced signal by pseudo-random noise.

6. A method of characterizing the excitation vector in a processor of speech operating in accordance with code-excited linear prediction (CELP), the method comprising the steps of:

establishing a set of sub-vectors, each of which comprises several samples of speech;

identifying sub-vectors carrying speech information important for perception of speech by a person listening to the speech;

encoding perceptually important sub-vectors;

setting other ones of the sub-vectors to zero, and constructing the excitation vector of the set of sub-vectors wherein the excitation vector is quantized by the sub-vectors which have been set to zero; and wherein the total number of the sub-vectors is equal to the integer part of pitch divided by 9 and bounded by 3 and 6 wherein 9 samples of speech are grouped together to form one of said sub-vectors;

in said speech processor, there is a dosed-loop operation for comparing synthesized speech and original speech to determine distortion, the processor including a linear predictor for receiving a target vector; and wherein the method comprises a further step of applying the target vector to the linear predictor for generating a residual, and filtering the residual by a pitch filter to eliminate long term correlation in each of a plurality of sub-frames.

7. A method of characterizing the excitation vector in a processor of speech operating in accordance with code-excited linear prediction (CELP), the method comprising the steps of:

establishing a set of sub-vectors, each of which comprises several samples of speech;

identifying sub-vectors carrying speech information important for perception of speech by a person listening to the speech;

encoding perceptually important sub-vectors;

setting other ones of the sub-vectors to zero, and constructing the excitation vector of the set of sub-vectors wherein the excitation vector is quantized by the sub-vectors which have been set to zero;

wherein there are three of said perceptually important sub-vectors;

in said speech processor, there is a closed-loop operation for comparing synthesized speech and original speech to determine distortion, the processor including a linear predictor for receiving a target vector;

the method comprises a further step of applying the target vector to the linear predictor for generating a residual, and filtering the residual by a pitch filter to eliminate long term correlation in each of a plurality of sub-frames; and the total number of the sub-vectors is equal to the integer part of pitch divided by 9 and bounded by 3 and 6 wherein 9 samples of speech are grouped together to form one of said sub-vectors.

8. A method according to claim 7 wherein three bits are used to present the sub-vectors to be quantized.

9. A method of characterizing the excitation vector in a processor of speech operating in accordance with code-excited linear prediction (CELP), the method comprising the steps of:

establishing a set of sub-vectors, each of which comprises several samples of speech;

identifying sub-vectors carrying speech information important for perception of speech by a person listening to the speech;

encoding perceptually important sub-vectors;

setting other ones of the sub-vectors to zero, and constructing the excitation vector of the set of sub-vectors wherein the excitation vector is quantized by the sub-vectors which have been set to zero; and cyclically shifting the components of a perceptually important sub-vector to obtain further sequences of vector components suitable for application to a linear predictive, voice synthesis filter for generation of reconstructed speech.

10. A method according to claim 9 wherein said shifting is accomplished at a rate equal to the pitch of an original voice signal.

11. A method according to claim 9 further comprising a step of determining the presence of voiced and unvoiced signals inputted to said speech processor, and applying said identification and said encoding steps only to said voiced signals.

12. A method according to claim 11, wherein, in the presence of a strong voice, there is a step of representing the voice by two pulse algebraic CELP.

13. A method according to claim 11 wherein in the presence of an unvoiced signal, there is a step of representing the unvoiced signal by pseudo-random noise.

14. A method according to claim 10 further comprising a step of analyzing the original voice signal to determine the pitch.

* * * * *